United States Patent [19]

Hayes

[11] Patent Number: 4,677,697

[45] Date of Patent: Jul. 7, 1987

[54] CLEAN UP GLOVE

[76] Inventor: Starr R. Hayes, 1312 Bergan Rd., Oreland, Pa. 19075

[21] Appl. No.: 691,607

[22] Filed: Jan. 14, 1985

[51] Int. Cl.[4] ..... A41D 19/00; B65D 85/00; B65D 30/10

[52] U.S. Cl. ..... 2/159; 2/169; 206/278; 206/390; 294/1.3; 383/4; 383/63

[58] Field of Search ..... 206/390, 278, 286, 205; 2/167, 168, 169, 162, 158, 159; 604/292; 383/63, 4; 294/1.3, 25, 1.4, 1.5; 428/905

[56] References Cited

U.S. PATENT DOCUMENTS

| | | | |
|---|---|---|---|
| 774,489 | 11/1904 | Noll | 2/169 |
| 3,229,875 | 1/1966 | Stoller | 206/390 |
| 3,481,461 | 12/1969 | Paxton | 206/390 |
| 3,681,784 | 8/1972 | Lindley | 2/162 |
| 4,034,853 | 7/1977 | Smith | 206/390 |
| 4,186,955 | 2/1980 | Campbell | 206/223 |
| 4,215,886 | 8/1980 | Naderi et al. | 294/1.3 |
| 4,285,105 | 8/1981 | Kirkpatrick | 383/63 |
| 4,345,716 | 8/1982 | Armstrong et al. | 428/905 |
| 4,349,104 | 9/1982 | Hayes | 206/205 |

FOREIGN PATENT DOCUMENTS

| | | | |
|---|---|---|---|
| 429572 | 7/1967 | Switzerland | 206/390 |
| 2100581 | 1/1983 | United Kingdom | 294/1.3 |
| 2114871 | 9/1983 | United Kingdom | 2/158 |

*Primary Examiner*—Louis K. Rimrodt
*Assistant Examiner*—Joseph S. Machuga
*Attorney, Agent, or Firm*—David J. Johns

[57] ABSTRACT

A disposable plastic clean up glove is economical to manufacture and easy to use and is made from two sheets of thermo setting plastic sheets joined together by heat sealing into shape and perforated for easy detachment. A fastener cut extends along the outside of the cuff portion and a tie strip extends along the fastener. Once an object is picked up using the glove, the glove is turned inside out to form a container and the fastener closed. The tie strip may be closed for double security and an aroma bubble located on the outside of the glove, now inside of the container, is burst to disinfect and deodorize the held contents.

4 Claims, 5 Drawing Figures

FIG. 1.
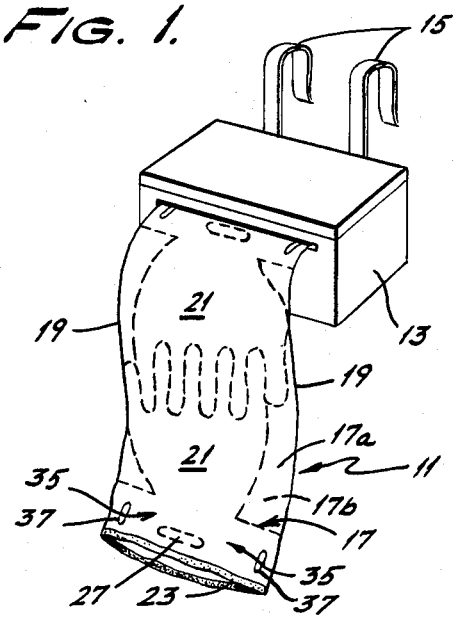
FIG. 2.
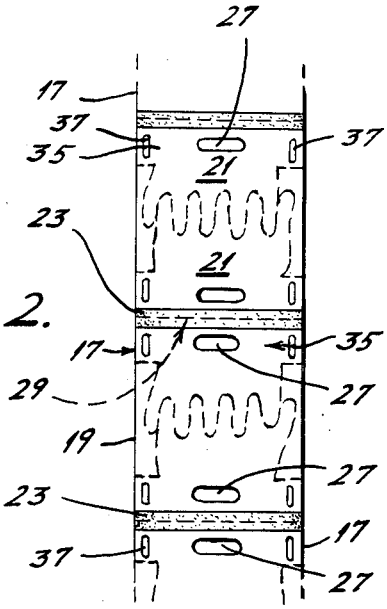
FIG. 3.
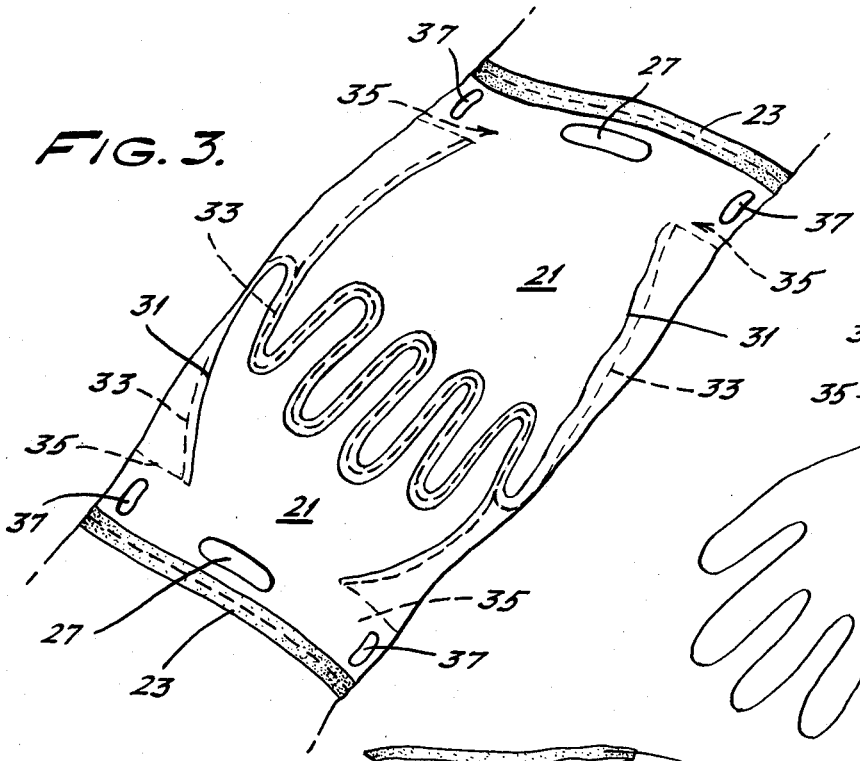
FIG. 4.
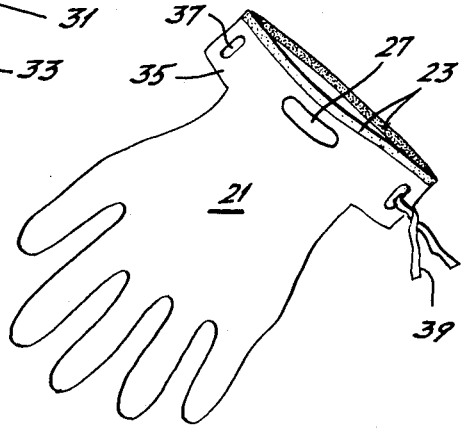
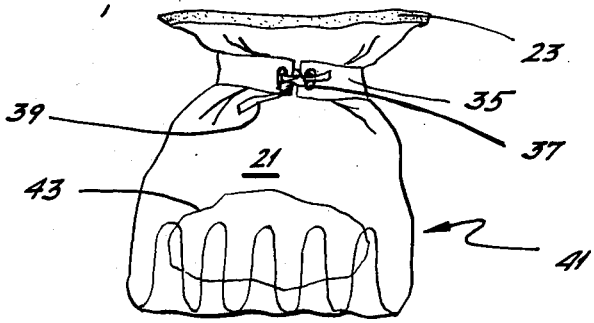
FIG. 5.

CLEAN UP GLOVE

BACKGROUND OF THE INVENTION

This invention relates to clean up gloves and clean up bags, and specifically the conversion of an economical plastic glove into a disposal bag.

Many types of disposable clean up bags have been developed. These often take the form of the bag of Rutherford, Great Britain Patent No. 2,100,581A, the bag of Marvin, U.S. Pat. No. 3,813,121, the bag of Dahlke, U.S. Pat. No. 3,837,696, the bag of Naderi, U.S. Pat. No. 4,215,886, the bag of Johnson, U.S. Pat. No. 3,850,467 or the bag of Larsson, U.S. Pat. No. 4,132,442.

These bags have manipulative components which often are troublesome to operate. Often the object being cleaned up cannot be properly cleaned or scraped up without additional manipulation from a free hand or another scraper. Very often the inexperienced clean up operator contaminates his own hands in using these clean up bags. Often the only sure way of protecting the operator from this contamination is for the operator to wear additional protection such as plastic gloves.

This adds to the cost of the clean up materials as the additional plastic gloves must either be cleaned or disposed of.

Further, all of the above collection bags include a metal scraper or other metal or plastic component which adds to the cost of the disposable clean up bag, and renders each unused bag bulky to store before use. This scraper or jaw component is contaminated upon usage and either requires disinfecting or clean up afterwards or is disposed of in the bag. When disposed of with the bag, it adds to the bulk size of the waste and often creates a puncture hazard to the bag.

Inexpensive disposable plastic gloves are often used in clean up operations. These provide distinct advantages over the bags, cited above; in that they are form fitting to the clean up operator's hands, protect the operator from contamination in awkward clean up situations and are usually easy to store before use.

In the past, such gloves were provided by Smith, U.S. Pat. No. 3,596,798, Stager, U.S. Pat. No. 4,186,445 and Smith, U.S. Pat. No. 4,034,853. However, once such gloves were used, an additional disposal bag or disposal carton as shown by Campbell, U.S. Pat. No. 4,186,955 was needed. These additional disposal containers add to the expense and to the storage requirements for clean up materials. The contaminated gloves themselves require disinfection after use, or are required to be disposed of. Even in this latter case, contaminent material clinging to the glove may cause additional unwanted contamination. This is true even if the contaminated glove is turned inside out as particulate matter can fall off and out of the turned glove.

It is the object of this invention to provide a clean up glove which is simple, economical and disposable and which combines the advantages of both plastic gloves and of sealable disposal bags while overcoming the disadvantages of each.

SUMMARY OF THE INVENTION

The objects of this invention are realized in a simple and economical, disposable clean up glove which is convertable into a disposable clean up bag upon use.

This glove can be used for cleaning up a variety of substances from household spills to animal messes to industrial chemicals and wastes.

A glove outline, pre-shaped into a hand format is redundantly formed into two sheets of thermo-plastic material thereby joined together. A perforation or "cut line" can be pinched into the sheets to allow ease of separation of a glove from the plastic roll formed from two separate sheets.

The improvement in this technology is achieved by a close-packing of glove outlines on the strip or roll of plastic film from which the gloves are made; and by providing a sealing structure at the wrist end of the glove, as well as, a disinfectant or neutralizer bubble pack at the wrist end.

DESCRIPTION OF THE DRAWINGS

The advantages, features and operation of this invention can be learned from a reading of the following detailed description of the invention in conjunction with the accompanying drawings in which like numerals refer to like elements and in which FIG. 1 is a perspective view of a dispenser box and ribbon of sheet material carrying the gloves of the invention;

FIG. 2 is a plan view of the ribbon sheet material from which the gloves of the invention are formed;

FIG. 3 is a perspective view of a pair of gloves separated from the ribbon shown in FIGS. 1 and 2;

FIG. 4 is a perspective view of a single glove separated from the pair shown in FIG. 3; and FIG. 5 is a perspective view of the glove of FIG. 4 which has been turned inside out and sealed at the wrist to form a disposal bag.

DETAILED DESCRIPTION OF THE INVENTION

A roll dispensable sheet 11 of disposable gloves, FIG. 1, is capable of being dispensed from a box 13 or other type container. This box 13 can be mounted to a wall or counter by hooks 15 or other such means. The sheet 11 is a flat tube 17 comprising two sheets 17*a*, 17*b* of thermoplastic material joined at the edges 19.

Formed into the flat tube 17 are pairs of gloves 21 in a compact juxtaposed arrangement whereby the fingers are interleaved. A fastener 23 is positioned across the tube 17 on its outside at the wrist or cuff location of each glove 21. A tie slot 25 is also positioned on each side of the wrist cuff of each glove 21. A bubble pack 27 is positioned on the outside of one of said sheets 17*a* forming said flat tube 17 at said wrist cuff of each said glove 21.

The flat tube 17, FIG. 2, carries said fasteners 23 at regular spacing therealong. The spacing between fasteners 23 being determined by the length of said flat tube 17 needed for a pair of gloves 21.

The fasteners 23 are joined to the outside of the flat tube 17 with one mating member connected to one sheet 17*a* and the other mating member connected to the other sheet 17*b*. The fasteners 23 carry a cut line which allows a separation between gloves 21 at the wrist cuff and allows a fastener 23 to be carried by each glove removed from the flat tube 17.

The fasteners 23 can be of a bead and interlock type popularized in the marketplace under the trademark "Ziplock", or of the hook and loop type popularized in the marketplace under the trademark "Velcro", or of any other design which enables an air-tight seal.

A pair of the gloves 21 can be torn from the flat tube 17 by separating at the transverse separation or cut line 20 at a fastener 29, FIG. 3.

The gloves 21 are formed by a solid thermoplastic seal line 31 defining their outline. A cut line 33 extends around each glove 21 and then runs transverse to the edge of the flat tube 17 to form a tab 35 on each edge of each glove 21 at the wrist cuff. These tabs 35 follow each fastener 23 to the edge of the flat tube 17.

Each tab 35 carries a slot 37 or opening. The cut lines 33 allow the gloves 21 to be separated and each glove 21, with its two tabs 35 and wrist cuff fastener 23 to be separated from the flat tube 17.

A tie 39 can be attached to one of the slots 37 on each glove 21, FIG. 4. Each bubble package 27 is carried on the outside of the glove 21 formed by the first sheet 17*a*.

The glove 21, FIG. 4, once removed from the flat tube 17, can be used to clean up household messes, animal and pet dirt, industrial wastes, caustic substances and many other materials according to the selection of the materials used in the sheets 17*a*, 17*b*. These sheets 17*a*, 17*b* which form the glove 21 need not be thermoplastic but can be of rubber compound or other pliable material.

Once used the glove 21 is turned inside out with the contaminated side in, FIG. 5. This is accomplished by grasping the glove 21 at the fastener 23 and stripping it downwardly off of the hand. When turned inside out, the walls of the glove 21 are in correct orientation for the fastener 23 to be closed thereby sealing off the glove 21 and making a disposal bag 41.

The fastener 23 provides an air tight seal for the bag 41, FIG. 5. The tabs 35 can be tied together using the tie 39 to provide a secure closure at the top of the bag 41. The tabs 35 and tie 39 are used to draw in the fastener 23 end of the bag 41. The bubble package 27 is burst, once the bag 41 is tied, to coat any contaminent 43 held within the bag 41.

Changes can be made to this clean up glove which is convertible into a disposal bag without departing from the intent and scope thereof. The above description, therefore, is to be considered as illustrative of the invention and not as limiting the invention to this specific embodiment.

What is claimed is:

1. A pair of disposable clean up gloves separably attached to one another, comprising:

a pair of pliable film hand-shaped enclosures with finger shapes and open wrist ends, said finger shapes of each glove interlacing with those of the other glove, each said glove having a first and second edge;

means for fastening closed said open wrist ends of each said hand shaped enclosue, said fastening closed means being positioned on the normally outer side of each said hand shaped enclosure near said open wrist end;

said fastening closed means including a first closure member to join said wrist ends in a straight line seal, and a second closure member to draw said wrist ends together;

said first closure member including a male interlocking strip on one side of said wrist end and a female interlocking strip on the other side of said wrist end; and said second closure member comprising a first tab extending outwardly on the first edge of each said glove at said wrist end and a second tab extending outwardly on the second edge of each said glove at said wrist end, said first and second tabs being long enough to be tied together.

2. The pair of gloves of claim 1 wherein each said first and second tab has a slot and each said glove includes a tie to join said first tab slot and said second tab slot.

3. The pair of gloves of claim 1 wherein each said glove includes a container of aromatic disinfectant on each said outer side near each said wrist end, said container of aromatic disinfectant being a bustable bubble pack of weaker material than said pliable film.

4. A pair of gloves of claim 1 wherein said pliable film is thermoplastic.

* * * * *